United States Patent [19]

Orth et al.

[11] Patent Number: 4,542,852

[45] Date of Patent: Sep. 24, 1985

[54] VIBRATION DAMPING DEVICE FOR THERMOSTATIC EXPANSION VALVES

[75] Inventors: Charles D. Orth, Lake Forrest; Robert J. Torrence, Addison, both of Ill.

[73] Assignee: The Singer Company, Stamford, Conn.

[21] Appl. No.: 586,169

[22] Filed: Mar. 5, 1984

[51] Int. Cl.[4] ..... F25B 41/04

[52] U.S. Cl. ..... 236/92 B; 62/225; 137/514; 188/381; 251/64; 267/161

[58] Field of Search ..... 236/92 B; 62/225; 137/514; 251/64, 297; 188/381, 129; 267/160, 161, 163

[56] References Cited

U.S. PATENT DOCUMENTS

| | | | |
|---|---|---|---|
| 2,573,522 | 10/1951 | Watt | 236/92 B |
| 2,801,801 | 8/1957 | Gillick et al. | 251/64 X |
| 2,966,169 | 12/1960 | Reece | 251/297 X |
| 3,017,157 | 1/1962 | Parsons et al. | 251/297 X |
| 3,072,143 | 1/1963 | Fleischhacker | 137/514 |
| 3,339,882 | 9/1967 | Grove | 251/64 |
| 3,476,148 | 11/1969 | McMillen | 251/297 X |
| 3,483,888 | 12/1969 | Wurzel | 267/161 X |
| 3,746,301 | 7/1973 | Budzich et al. | 251/64 |
| 3,809,186 | 5/1974 | Suozzo | 188/129 X |
| 3,810,485 | 5/1974 | Gawlick et al. | 251/64 X |
| 4,024,888 | 5/1977 | Jacyno | 137/514 |

*Primary Examiner*—William E. Tapolcai

*Attorney, Agent, or Firm*—David L. Davis; Robert E. Smith; Edward L. Bell

[57] ABSTRACT

A vibration damping device for a thermostatic expansion valve comprises a spring member having a plurality of cantilevered fingers substantially parallel to the direction of travel of moving components but which are spring loaded to provide a force normal to that direction. The damping device is fixedly attached to one of the moving or stationary components and is arranged so that its fingers exert the normal force against the other of the moving or stationary components. Accordingly, a constant magnitude frictional force is produced over the range of movement, thus damping vibrations caused by pressure pulses from the compressor of the refrigeration system in which the thermostatic expansion valve is installed.

4 Claims, 9 Drawing Figures

VIBRATION DAMPING DEVICE FOR THERMOSTATIC EXPANSION VALVES

DESCRIPTION

BACKGROUND OF THE INVENTION

This invention relates to thermostatic expansion valves and, more particularly, to a vibration damping device for preventing the internal valve components from resonating during operation.

Thermostatic expansion valves are used in air conditioning and refrigeration systems to control refrigerant flow to the evaporator under varying heat load conditions. A typical construction of this type of valve is illustrated in U.S. Pat. No. 3,537,645 and such construction usually employs a ball and pad assembly, push-pin, and rider pin suspended between a diaphragm and a spring. The spring/mass system is inherently underdamped and thus susceptible to resonance initiated by pressure pulses from the compressor. The resultant resonance could cause the valve to open and close, amplifying pressure pulsation upstream of the thermostatic expansion valve. Under certain conditions, the system piping could be forced into resonance, producing an unwanted audible noise.

One prior attempt at controlling system noise was to install mufflers in the system. These were typically placed in the suction or discharge piping at the compressor. This, however, did not always solve noise problems in systems and also added considerable expense to the system. Another prior method of solving the problem was to change the configuration of the high pressure piping between the receiver and the valve. This caused a shift in the resonant frequency of the piping, making it more difficult for the valve oscillation to force the piping into resonance. This was a trial and error procedure and did not always prove to be effective.

It is therefore an object of this invention to provide an inexpensive and effective device for damping vibrations in a thermostatic expansion valve.

SUMMARY OF THE INVENTION

The foregoing and additional objects are attained in accordance with the principles of this invention by providing, in a thermostatic expansion valve of the type having a valve body and a valve actuator mechanism slidably secured in the valve body, an arrangement for damping vibration of the actuator mechanism comprising means interposed between the valve body and the actuator mechanism for applying a constant force therebetween in a direction normal to the direction of sliding motion of the actuator mechanism.

In accordance with an aspect of this invention, the force applying means includes a ring shaped member fixedly secured to one of the valve body or the actuator mechanism, the member having a plurality of fingers extending in the direction of the sliding motion and biased into force applying contact with the other of the valve body or actuator mechanism.

In accordance with another aspect of this invention, the force applying means is formed as a unitary member of spring metal with the fingers supplying the biasing force.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
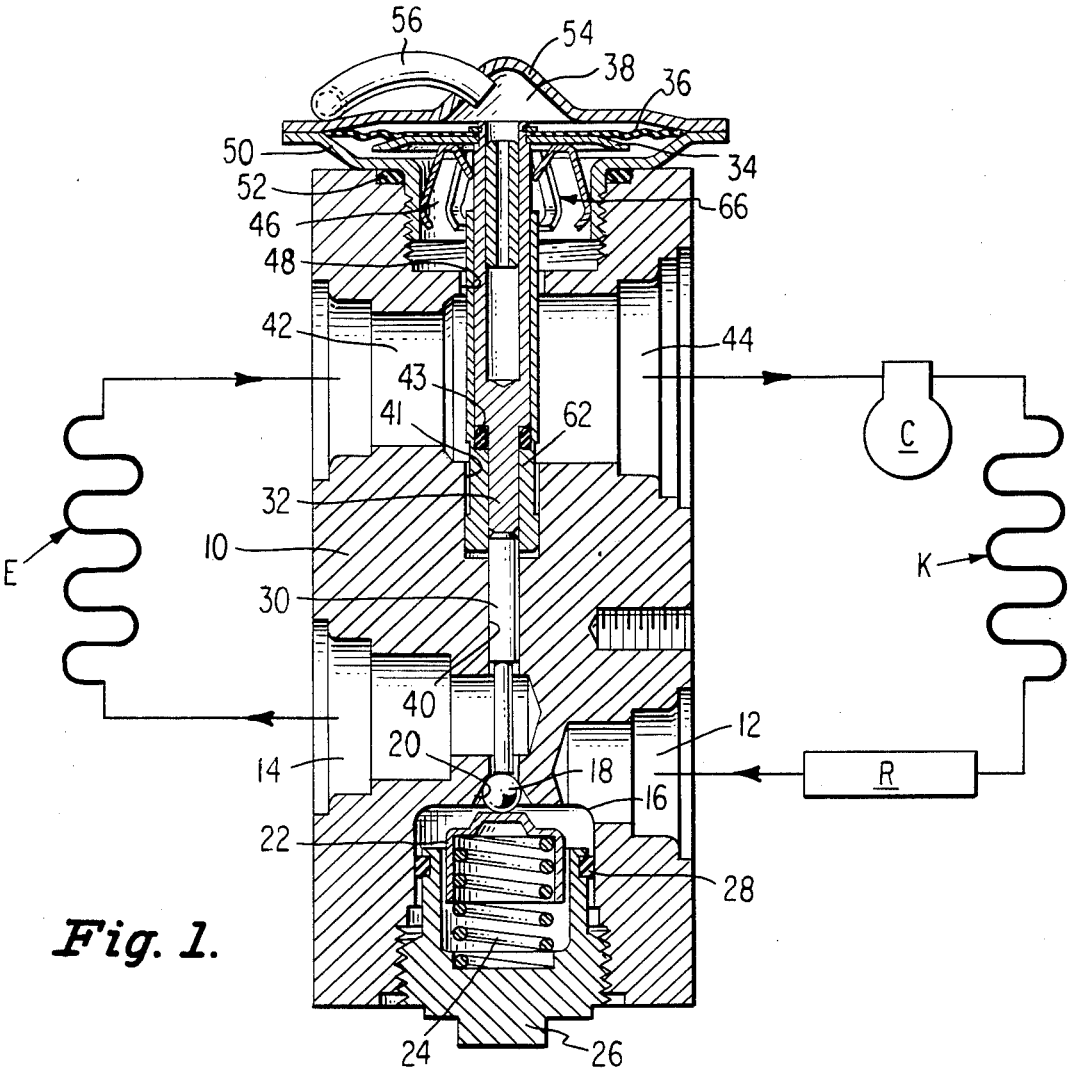
FIG. 1 is a longitudinal sectional view of a typical thermostatic expansion valve, combined with a schematic of a refrigeration system, and having installed therein a vibration damping device according to this invention.

Referring now to the drawings, the thermostatic expansion valve shown in FIG. 1 includes a valve body 10, the lower portion of which is provided with an inlet 12 and an outlet 14 separated by a partition through which port 16 is provided to supply refrigerant to the space below the partition. Ball type valve 18 cooperates with seat 20 to control flow from the inlet 12 to the outlet 14. The ball 18 is centered on a cup 22 which is urged in the valve closing direction by a spring 24 compressed between the cup 22 and the adjustment plug 26 threaded into the end of the valve body 10 and adjustable to change the spring force. The O-ring 28 seals the joint between the adjustment plug 26 and the valve body 10.

The valve 18 is actuated by a push-pin 30 which, in turn, is actuated by a diaphragm rider pin 32 fixed to the diaphragm pad 34 and having an end projection projecting through the pad 34 and the diaphragm 36 to communicate with the head chamber 38. The pin 30 has a close sliding fit in the bore 40 to minimize leakage along this portion since any such leakage would constitute a bypass. The O-ring 43 seals against leakage between the pin 32 and the inside of the sleeve 62.

In the upper portion of the valve body 10 there is a return conduit including an inlet 42 connected to the outlet of the evaporator E and an outlet 44 connected to the inlet of the compressor C. It will be appreciated that, as usual, the output of the compressor C is fed into the condenser K and thence to the receiver R which is connected to the inlet 12 of the valve body 10. Pressure within the return conduit can communicate with the chamber 46 below the diaphragm 36 through the port 48 in the upper wall of the valve body 10. The diaphragm 36 is mounted between domed head 54 and support cup 50 threaded into the upper end of the valve body 10 and sealed with respect thereto by means of O-ring 52. The head chamber 38 is charged with a temperature responsive charge through the capillary tube 56 which is then sealed off.

Under certain conditions, pressure pulses caused by the compressor C drive the valve actuator mechanism including the valve ball 18, the push-pin 30 and the rider pin 32, into oscillation. In accordance with the principles of this invention, a spring vibration damper 66 is rigidly attached to the rider pin 32. As shown in FIGS. 2 and 3, the vibration damper 66 is a ring-shaped member having a plurality of fingers 68 which extend in the direction of sliding motion of the actuator mechanism relative to the valve body. The vibration damper 66 is formed as a unitary member of spring metal so that the fingers 68, after being bent as at 70, if pressed closer together exert an outwardly directed force. The vibration damper 66 is also formed with a plurality of gripping tabs 72 which serve to fixedly secure the damping device 66 on the rider pin 32. As shown in FIG. 1, the fingers 68 are in contact with the support cup 50 and are self-biased thereagainst to apply a constant force between the rider pin 32 and the support cup 50 in a direction normal to the direction of motion of the rider pin 32. Accordingly, sliding friction is generated to damp vibrations so as to prevent the moving components from resonating, which would otherwise tend to force the system piping into subsequent resonance. The aforedescribed arrangement is additionally advantageous in that, in addition to producing damping in the axial direction, no axial spring forces are generated which would result in varying force versus displacement, which would upset the normal operation of the control valve vis a vis calibrated spring forces. The aforedescribed arrangement produces a constant magnitude frictional force in the axial direction.

Figure 2:
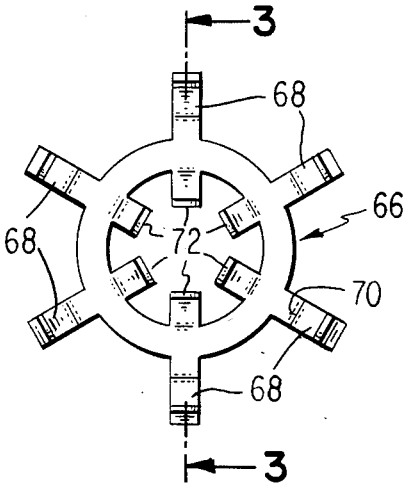
FIG. 2 is a plan view of the vibration damping device installed in the valve of FIG. 1.
Figure 3:
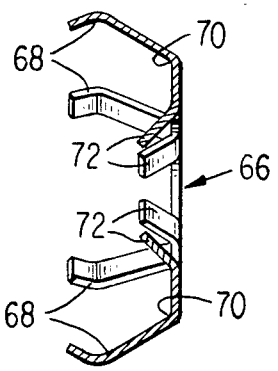
FIG. 3 is a sectional view taken along the line 3—3 in FIG. 2.
Figure 4:
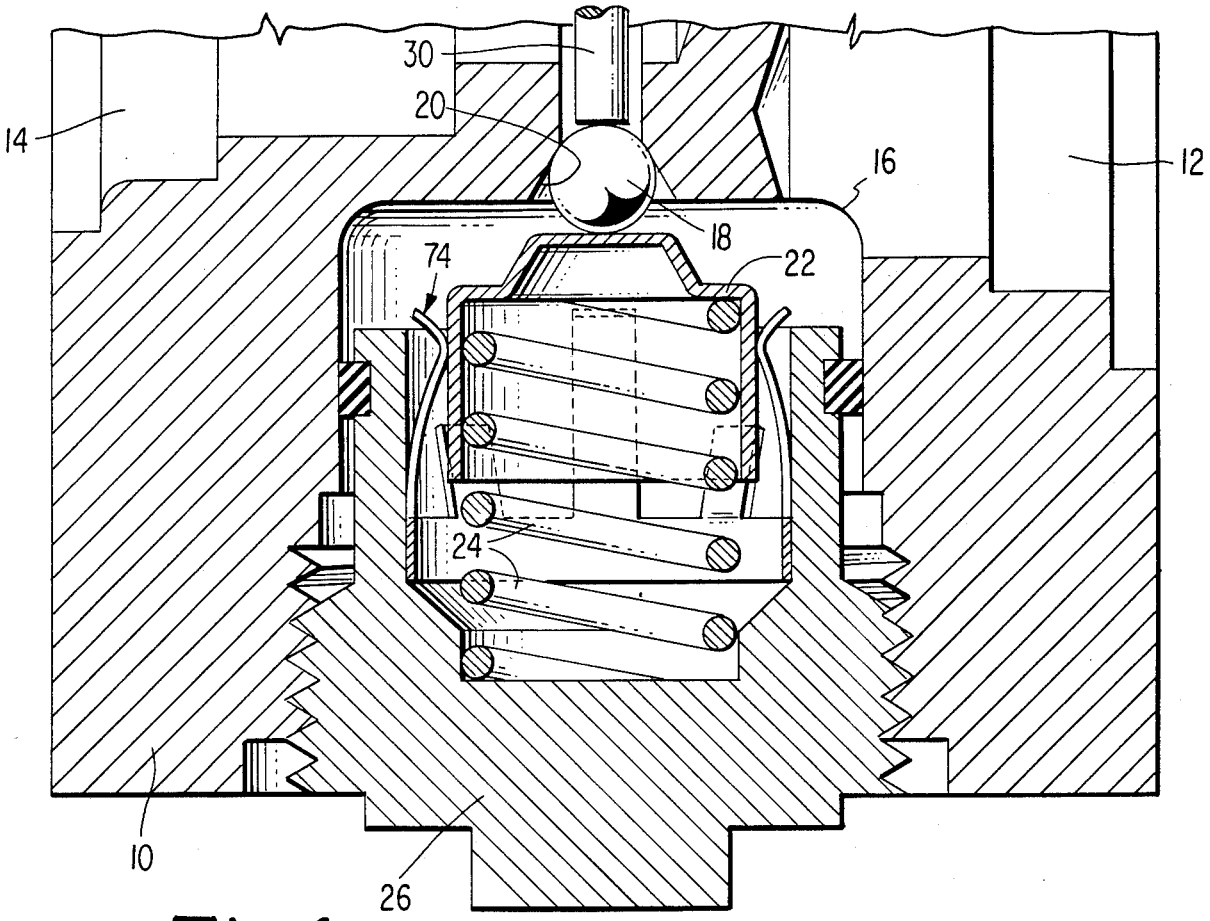
FIG. 4 is an enlarged detail of a portion of the valve of FIG. 1 showing the installation of a second embodiment of a vibration damping device according to this invention.
Figure 6:
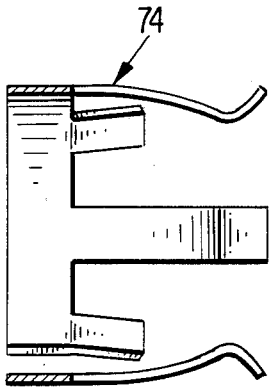
FIG. 6 is a sectional view taken along the line 6—6 in FIG. 5.
Figure 5:
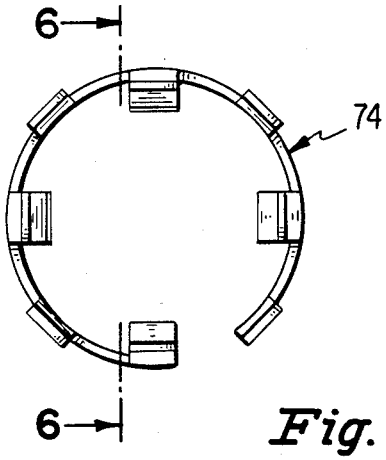
FIG. 5 is a plan view of the vibration damping device shown in FIG. 4.
Figure 7:
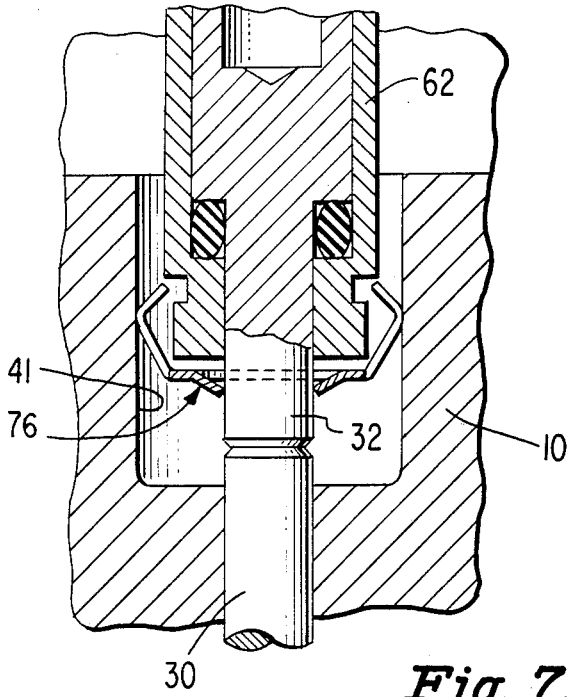
FIG. 7 is an enlarged detail of a portion of the valve of FIG. 1 showing the installation of a third embodiment of a vibration damping device according to this invention.
Figure 8:
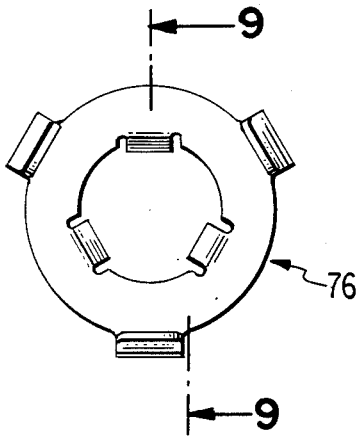
FIG. 8 is a plan view of the vibration damping device shown in FIG. 7.
Figure 9:
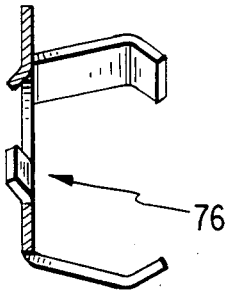
FIG. 9 is a sectional view taken along the line 9—9 in FIG. 8.

It will be appreciated that a device such as that illustrated with respect to FIGS. 1–3 can be provided in various locations within the valve to achieve the same results. Thus, FIGS. 4–6 illustrate a second embodiment of the present invention wherein a vibration damping device 74 is attached to the interior of the adjustment plug 26 to apply a force to the cup 22. Likewise, a third embodiment is illustrated in FIGS. 7–9 wherein the rider pin 32 is modified to extend outside the sleeve 62, the bore 41 is enlarged, and a vibration damping device 76 is attached to the rider pin 32 and provides a force against the wall of the bore 41.

Accordingly, there have been disclosed embodiments of a vibration damping device for a thermostatic expansion valve. It is understood that the above-described embodiments are merely illustrative of the application of the principles of this invention. Numerous other embodiments may be devised by those skilled in the art without departing from the spirit and scope of this invention, as defined by the appended claims.

We claim:

1. In a thermostatic expansion valve of the type having a valve body and a valve actuator mechanism slidably secured in said valve body, an arrangement for damping vibration of said actuator mechanism comprising:

means interposed between said valve body and said actuator mechanism for applying a constant force therebetween in a direction normal to the direction of sliding motion of said actuating mechanism including a unitary ring shaped member of spring metal fixedly secured to one of said valve body or said actuator mechanism, said member having a plurality of fingers extending in the direction of said sliding motion and biased into force applying contact with the other of said valve body or said actuator mechanism and a plurality of gripping tabs extending in the direction of said sliding motion but across the ring shaped member from said fingers into gripping engagement with said one of said valve body or said actuator mechanism.

2. The arrangement according to claim 1 wherein said valve body is formed with a chamber sealed by a diaphragm and said valve actuating mechanism includes a rider pin extending through said chamber for connection to said diaphragm, said member being mounted on said rider pin with said fingers contacting the wall of said chamber.

3. The arrangement according to claim 1 wherein said thermostatic expansion valve includes a valve and valve seat, and said valve actuator mechanism includes a cup and a spring urging said valve toward said valve seat, said cup and said spring being supported in a chamber formed in said valve body, said member being supported within said chamber with said fingers contacting said cup.

4. The arrangement according to claim 1 wherein said valve actuating mechanism includes a rider pin extending through a bore formed in said valve body and said member is mounted on said rider pin with said fingers contacting the wall of said bore.

* * * * *